US010309246B2

(12) United States Patent
Miranda

(10) Patent No.: US 10,309,246 B2
(45) Date of Patent: Jun. 4, 2019

(54) PASSIVE CLEARANCE CONTROL SYSTEM FOR GAS TURBOMACHINE

(71) Applicant: General Electric Company, Schenectady, NY (US)

(72) Inventor: Carlos Miguel Miranda, Greer, SC (US)

(73) Assignee: General Electric Company, Schenectady, NY (US)

( * ) Notice: Subject to any disclaimer, the term of this patent is extended or adjusted under 35 U.S.C. 154(b) by 341 days.

(21) Appl. No.: 15/175,597

(22) Filed: Jun. 7, 2016

(65) Prior Publication Data

US 2017/0350269 A1 Dec. 7, 2017

(51) Int. Cl.
*F02C 6/08* (2006.01)
*F01D 11/24* (2006.01)

(52) U.S. Cl.
CPC ..... *F01D 11/24* (2013.01)

(58) Field of Classification Search
CPC ..... F01D 11/24; F01D 11/16; F01D 25/12; F01D 25/14; F02C 3/04; F02C 7/18
See application file for complete search history.

(56) References Cited

U.S. PATENT DOCUMENTS 2,843,354 A 7/1958 Smith
3,575,528 A * 4/1971 Beam, Jr. ..... F01D 5/08 415/115
3,973,874 A 8/1976 Corsmeier et al.
3,975,901 A * 8/1976 Hallinger ..... F01D 11/16 60/786

(Continued)

FOREIGN PATENT DOCUMENTS

DE 4430302 A1 2/1996
EP 1152125 A1 11/2001

(Continued)

OTHER PUBLICATIONS

EP Search Report and Written Opinion dated May 6, 2014 in connection with corresponding EP Patent Application No. 13165921.1.

(Continued)

*Primary Examiner* — Jesse S Bogue

(74) *Attorney, Agent, or Firm* — Ernest G. Cusick; Hoffman Warnick LLC

(57) ABSTRACT

A turbomachine includes a compressor portion, and a turbine portion operatively connected to the compressor portion. The turbine portion includes a turbine casing. A combustor assembly, including at least one combustor, fluidically connects the compressor portion and the turbine portion. At least one of the compressor portion, turbine portion and combustor assembly includes a sensing cavity. A passive clearance control system is operatively arranged in the turbomachine. The passive clearance control system includes at least one passive flow modulating device mounted in the sensing cavity, and at least one cooling channel extending from the sensing cavity through the casing. The at least one passive flow modulating device selectively passes the fluid from the sensing cavity through the at least one cooling channel to adjust a clearance between stators and rotating airfoils in the turbine portion.

7 Claims, 5 Drawing Sheets

(56) References Cited

U.S. PATENT DOCUMENTS

| | | | | |
|---|---|---|---|---|
| 4,023,731 | A * | 5/1977 | Patterson | F01D 11/18 236/101 R |
| 4,304,093 | A * | 12/1981 | Schulze | F01D 11/24 60/39.091 |
| 4,363,599 | A | 12/1982 | Cline et al. | |
| 4,443,389 | A | 4/1984 | Dodds | |
| 4,487,016 | A * | 12/1984 | Schwarz | F01D 5/082 415/116 |
| 4,613,280 | A * | 9/1986 | Tate | F01D 11/005 415/110 |
| 4,805,398 | A * | 2/1989 | Jourdain | F01D 5/082 236/93 R |
| 5,120,192 | A | 6/1992 | Ohtomo et al. | |
| 5,219,268 | A * | 6/1993 | Johnson | F01D 11/24 415/115 |
| 5,259,730 | A | 11/1993 | Damlis et al. | |
| 5,297,386 | A | 3/1994 | Kervistin | |
| 5,363,654 | A | 11/1994 | Lee | |
| 5,591,002 | A | 1/1997 | Cunha et al. | |
| 5,593,278 | A | 1/1997 | Jourdain et al. | |
| 5,704,763 | A | 1/1998 | Lee | |
| 6,116,852 | A * | 9/2000 | Pierre | F01D 11/24 415/115 |
| 6,152,685 | A | 11/2000 | Hagi | |
| 6,179,557 | B1 | 1/2001 | Dodd et al. | |
| 6,227,800 | B1 | 5/2001 | Spring et al. | |
| 6,419,146 | B1 | 7/2002 | Buldhaupt et al. | |
| 6,422,807 | B1 | 7/2002 | Leach et al. | |
| 6,428,273 | B1 | 8/2002 | Keith et al. | |
| 6,435,813 | B1 | 8/2002 | Rieck, Jr. et al. | |
| 6,478,534 | B2 | 11/2002 | Bangert et al. | |
| 6,533,547 | B2 | 3/2003 | Anding et al. | |
| 6,554,563 | B2 | 4/2003 | Noe et al. | |
| 6,641,363 | B2 | 11/2003 | Barrett et al. | |
| 6,659,714 | B1 | 12/2003 | Tiemann | |
| 6,742,783 | B1 | 6/2004 | Lawer et al. | |
| 6,769,875 | B2 | 8/2004 | Tiemann | |
| 6,779,597 | B2 | 8/2004 | DeMarche et al. | |
| 6,824,351 | B2 | 11/2004 | Endries et al. | |
| 6,877,952 | B2 * | 4/2005 | Wilson | F01D 11/18 415/136 |
| 6,925,814 | B2 | 8/2005 | Wilson et al. | |
| 7,347,671 | B2 | 3/2008 | Dorling et al. | |
| 7,434,402 | B2 | 10/2008 | Paprotna et al. | |
| 7,556,476 | B1 | 7/2009 | Liang | |
| 7,658,591 | B2 | 2/2010 | Dervaux et al. | |
| 7,740,444 | B2 | 6/2010 | Lee et al. | |
| 7,798,775 | B2 | 9/2010 | Kammel et al. | |
| 8,127,553 | B2 | 3/2012 | Ekkad et al. | |
| 8,128,341 | B2 | 3/2012 | Wieghardt | |
| 8,137,055 | B2 | 3/2012 | Lang | |
| 8,403,631 | B2 | 3/2013 | Surace et al. | |
| 8,549,864 | B2 * | 10/2013 | Langdon, II | F01D 17/085 251/11 |
| 8,616,827 | B2 * | 12/2013 | O'Leary | F01D 11/24 415/1 |
| 8,684,660 | B2 * | 4/2014 | Miranda | F01D 5/082 415/115 |
| 9,404,389 | B2 * | 8/2016 | Erickson | F01D 25/12 |
| 9,506,369 | B2 | 11/2016 | Boswell et al. | |
| 9,631,808 | B2 | 4/2017 | Taylor et al. | |
| 9,719,372 | B2 | 8/2017 | Ballard, Jr. et al. | |
| 9,777,636 | B2 * | 10/2017 | Morrill | F01D 11/24 |
| 9,926,801 | B2 * | 3/2018 | Uskert | F01D 11/24 |
| 9,945,250 | B2 | 4/2018 | Kitamura et al. | |
| 10,030,537 | B2 | 7/2018 | Dutta et al. | |
| 2002/0071762 | A1 | 6/2002 | Schroder | |
| 2003/0035722 | A1 | 2/2003 | Barrett et al. | |
| 2010/0247297 | A1 | 9/2010 | Legare et al. | |
| 2011/0027068 | A1 | 2/2011 | Floyd, II et al. | |
| 2011/0135456 | A1 | 6/2011 | Takahashi et al. | |
| 2012/0070302 | A1 | 3/2012 | Lee | |
| 2012/0247121 | A1 | 10/2012 | Kitamura et al. | |
| 2012/0247297 | A1 | 10/2012 | Kawaguchi et al. | |
| 2013/0017060 | A1 | 1/2013 | Boswell et al. | |
| 2015/0098791 | A1 | 4/2015 | Ballard, Jr. et al. | |
| 2015/0110612 | A1 | 4/2015 | Brandl et al. | |
| 2017/0284218 | A1 | 10/2017 | Kondo et al. | |
| 2017/0292389 | A1 | 10/2017 | Lorstad et al. | |
| 2018/0066527 | A1 | 3/2018 | Kadau et al. | |

FOREIGN PATENT DOCUMENTS

| | | | |
|---|---|---|---|
| EP | 1780376 | A1 | 5/2007 |
| EP | 1806476 | A1 | 11/2007 |
| EP | 2243933 | A1 | 4/2009 |
| EP | 2410128 | A1 | 1/2012 |
| JE | 19823251 | C1 | 7/1999 |

OTHER PUBLICATIONS

Office Action for U.S. Appl. No. 13/461,035, dated Dec. 17, 2014.
Final Office Action for U.S. Appl. No. 13/461,035, dated Apr. 22, 2015.
U.S. Appl. No. 13/461,035, Notice of Allowance dated Jun. 12, 2017, 10 pages.
U.S. Appl. No. 13/461,035, Office Action 2 dated Aug. 19, 2016, 24 pages.
U.S. Appl. No. 13/461,035, Office Action 3 dated Feb. 14, 2017, 19 pages.
U.S. Appl. No. 15/164,311, Office Action dated Sep. 7, 2018, 31 pages.
U.S. Appl. No. 15/207,743, Office Action dated Oct. 30, 2018, 33 pages.
U.S. Appl. No. 15/164,311, Notice of Allowance dated Jan. 10, 2019, 11 pages.
U.S. Appl. No. 15/175,576, Office Action dated Feb. 25, 2019, 256793A-1, 19 pages.

* cited by examiner

PASSIVE CLEARANCE CONTROL SYSTEM FOR GAS TURBOMACHINE

BACKGROUND

The subject matter disclosed herein relates to the art of turbomachines and, more particularly, to a passive clearance control system for a turbine portion of a gas turbomachine.

Gas turbomachines typically include a compressor portion, a turbine portion, and a combustor assembly. The combustor assembly mixes fluid from the compressor portion with a fuel to form a combustible mixture. The combustible mixture is combusted forming hot gases that pass along a hot gas path of the turbine portion. The turbine portion includes a number of stages having airfoils mounted to rotors that convert thermal energy from the hot gases into mechanical, rotational energy. Additional fluid from the compressor is passed through a shell of the gas turbomachine for cooling purposes.

BRIEF DESCRIPTION

According to one aspect of an exemplary embodiment, a turbomachine includes a compressor portion, and a turbine portion operatively connected to the compressor portion. The turbine portion includes a turbine casing, a plurality of stators fixedly mounted to the turbine casing, and a plurality of rotating airfoils rotatably supported in the turbine casing. A combustor assembly, including at least one combustor, fluidically connects the compressor portion and the turbine portion. At least one of the compressor portion, turbine portion, and combustor assembly includes a sensing cavity configured to contain a fluid having a fluid parameter indicative of a desired operational mode of the turbomachine. A passive clearance control system is operatively arranged in the turbomachine. The passive clearance control system includes at least one passive flow modulating device mounted in the sensing cavity and is responsive to the fluid parameter, and at least one cooling channel extending from the sensing cavity through the casing. The at least one passive flow modulating device selectively passes the fluid from the sensing cavity through the at least one cooling channel to adjust a clearance between the plurality of stators and the plurality of rotating airfoils.

According to another aspect of an exemplary embodiment, a turbomachine system includes a compressor portion and a turbine portion operatively connected to the compressor portion. The turbine portion includes a turbine casing, a plurality of stators fixedly mounted to the turbine casing, and a plurality of rotating airfoils rotatably supported in the turbine casing. An intake system is fluidically coupled to the compressor portion. The intake system is operative to condition a flow of intake air to the compressor portion. An exhaust system is fluidically connected to the turbine portion. The exhaust system is operative to condition a flow of exhaust gases passing from the turbine portion. A load is operatively connected to one of the turbine portion and the compressor portion. A combustor assembly, including at least one combustor, fluidically connects the compressor portion and the turbine portion. At least one of the compressor portion, turbine portion, and combustor assembly includes a sensing cavity configured to contain a fluid having a fluid parameter indicative of a desired operational mode of the turbomachine. A passive clearance control system is operatively arranged in the turbomachine. The passive clearance control system includes at least one passive flow modulating device mounted in the sensing cavity and is responsive to the fluid parameter, and at least one cooling channel extends from the sensing cavity through the turbine casing. The at least one passive flow modulating device selectively passes the fluid from the sensing cavity through the at least one cooling channel to adjust a clearance between the plurality of stators and the plurality of rotating airfoils.

According to yet another aspect of an exemplary embodiment, a method of adjusting rotor blade-to-stator clearance in a turbomachine includes sensing a fluid parameter of a fluid in a sensing cavity of the turbomachine indicative of a desired operating mode of the turbomachine, and actuating at least one passive flow modulating device in response to the fluid parameter, and passing the fluid from the sensing cavity to one or more cooling channels extending through a casing of a turbine portion to passively adjust rotor blade-to-stator clearance in the turbine portion.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Figure 1:
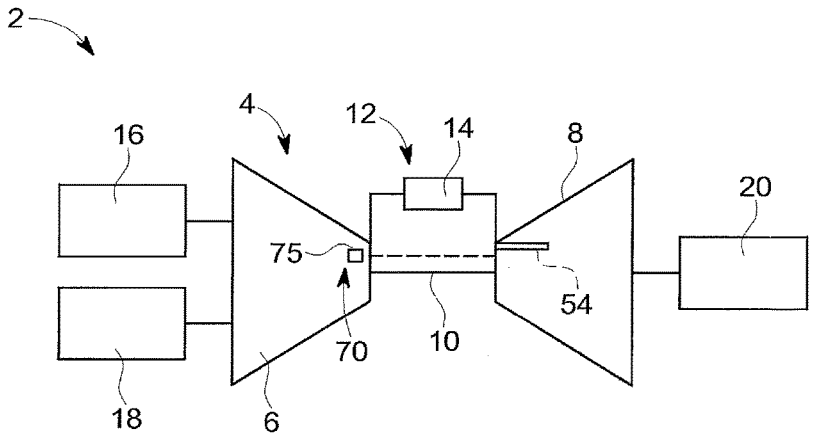
FIG. 1 is schematic view of a gas turbomachine including a passive clearance control system, in accordance with an exemplary embodiment.
Figure 2:
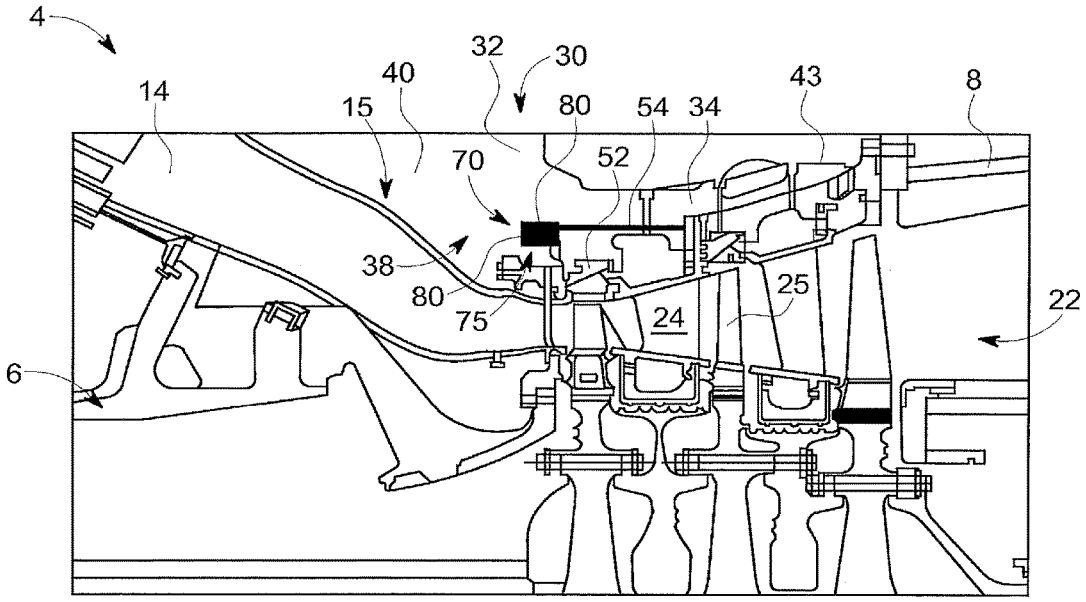
FIG. 2 is a partial cross-sectional side view of the turbomachine of FIG. 1.

A turbomachine system, in accordance with an exemplary embodiment, is indicated generally at 2, in FIGS. 1 and 2.

Turbomachine system 2 includes a turbomachine 4 having a compressor portion 6 and a turbine portion 8 operatively connected through a common compressor/turbine shaft 10. A combustor assembly 12 is fluidically connected between compressor portion 6 and turbine portion 8. Combustor assembly 12 includes at least one combustor 14 that directs products of combustion toward turbine portion 8 through a transition piece 15. An intake system 16 is fluidically connected to an inlet (not separately labeled) of compressor portion 6. In addition, a load 18 is mechanically linked to turbomachine 4 and an exhaust system 20 is operatively connected to an outlet (also not separately labeled) of turbine portion 8.

In operation, air is passed through intake system 16 into compressor portion 6. Intake system 16 may condition the air by, for example, lowering humidity, altering temperature, and the like. The air is compressed through multiple stages of compressor portion 6 and is passed to turbine portion 8 and combustor assembly 12. The air is mixed with fuel, diluents, and the like, in combustor 14 to form a combustible mixture. The combustible mixture is passed from combustor 14 into turbine portion 8 via transition piece 15 as hot gases. The hot gases flow along a hot gas path 22 of turbine portion 8. The hot gases interact with one or more stationary airfoils, such as shown at 24, and rotating airfoils, such as shown at 25, to produce work. The hot gases then pass as exhaust into an exhaust system 20. The exhaust may be treated and expelled to ambient or used as a heat source in another device (not shown).

In accordance with an exemplary embodiment, turbomachine 4 includes a casing or shell 30 having a compressor section 32 that surrounds compressor portion 6 and a turbine section 34 that surrounds turbine portion 8. Compressor section 32 includes a compressor discharge cavity (CDC) 38 that leads a portion of the compressed air into turbine portion 8 as cooling gas. In the exemplary embodiment shown, CDC 38 may take the form of a sensing cavity 40 that may contain a fluid having a fluid parameter, such as for example, pressure and/or temperature, indicative of a desired operational mode of turbomachine 4.

Figure 3:
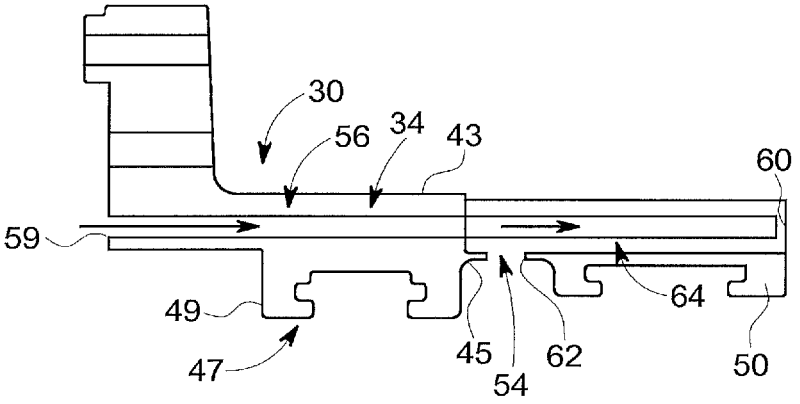
FIG. 3 is a partial cross-sectional side view of a portion of a turbine casing of the turbomachine of FIG. 2.

In accordance with an aspect of an exemplary embodiment illustrated in FIG. 3, turbine section 34 of casing 30 includes an outer surface 43 and an inner surface 45. Inner surface 45 includes a plurality of hook members 47. Hook members 47 may take the form of first stage shroud supports 49 and second stage shroud supports 50. First and second stage shroud supports 49 and 50 retain stators or shrouds, such as indicated at 52, to turbine section 34 of casing 30.

In addition, casing 30 includes a plurality of cooling channels 54 extending through turbine section 34 and arranged in a heat exchange relationship with hook members 47. As each of the plurality of cooling channels 54 is substantially similar, a detailed description will follow to one of the plurality of cooling channels indicated at 56 with an understanding that others of the plurality of cooling channels may be similarly formed. Cooling channel 56 includes a first end 59 exposed to sensing cavity 40, a second end 60 and an outlet 62. Outlet 62 may be fluidically connected with stationary airfoil 24. A baffle member 64 may be arranged in cooling channel 56 to establish a desired residence time of cooling air along hook members 47.

In accordance with an aspect of an exemplary embodiment, turbomachine 4 includes a passive clearance control system 70 that passively adjusts a clearance between tip portions (not separately labeled) of rotating airfoils 25 and shrouds (also not separately labeled) supported from hook members 47. By "passive" it should be understood that clearances are autonomously adjusted based solely on turbomachine parameters without the intervention of external programmed control systems and/or personnel.

In accordance with an aspect of an exemplary embodiment, passive clearance control system 70 includes a passive flow modulating device 75 fluidically exposed to sensing cavity 40. In an aspect of an exemplary embodiment, passive flow modulating device 75 may take the form of a valve 80 arranged in sensing cavity 40. Valve 80 may be responsive to pressure and/or temperature of fluid in sensing cavity 40. The pressure and/or temperature of the fluid may be indicative of a desired operational parameter of turbomachine 4. At a predetermined temperature and/or pressure, valve 80 may open passing cooling fluid from sensing cavity 40 through cooling channels 54. In this manner, casing 30 may adjust a desired clearance between rotating airfoils 25 and internal surfaces of casing 30. In accordance with an aspect of an exemplary embodiment, passive flow modulating device 75 may operate as an integrated sensor, actuator and valve that controls a flow of coolant from sensing cavity 40 to cooling channels 54.

Figure 4:
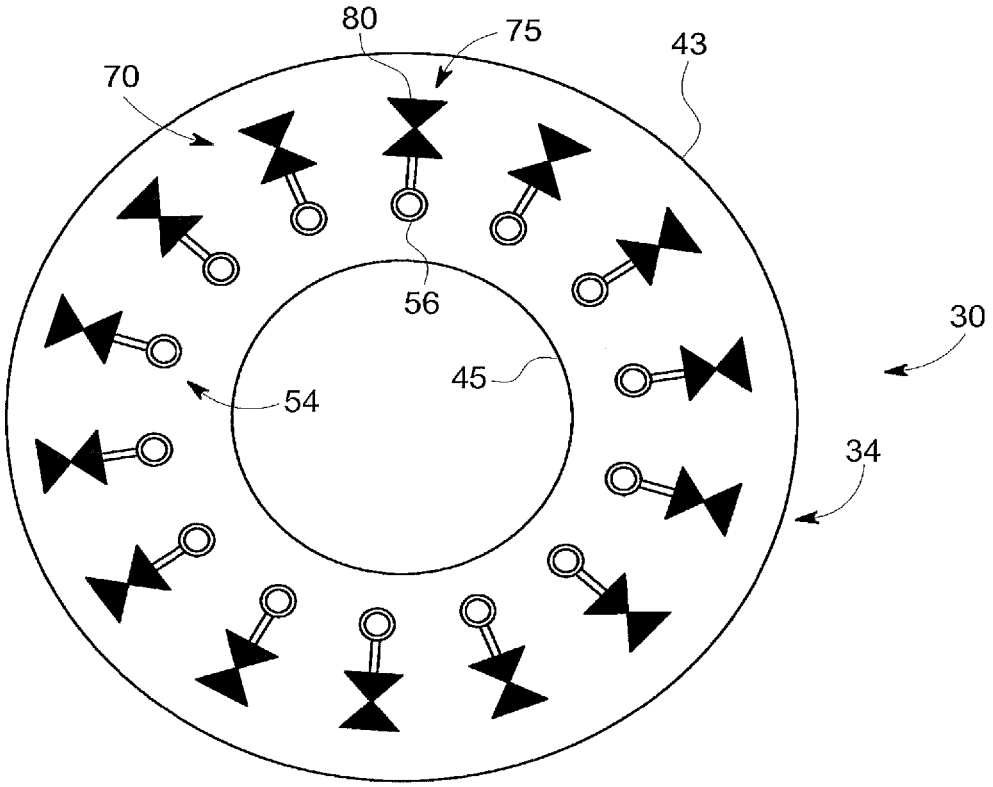
FIG. 4 is a schematic representation of an array of coolant channels of the passive clearance control system, in accordance with an aspect of an exemplary embodiment.
Figure 5:
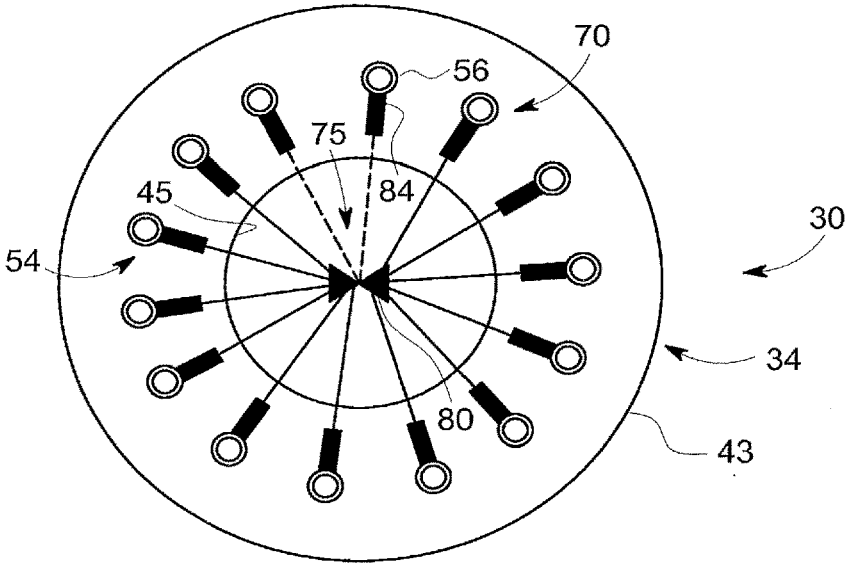
FIG. 5 is a schematic representation of an array of coolant channels of the passive clearance control system, in accordance with another aspect of an exemplary embodiment.
Figure 6:
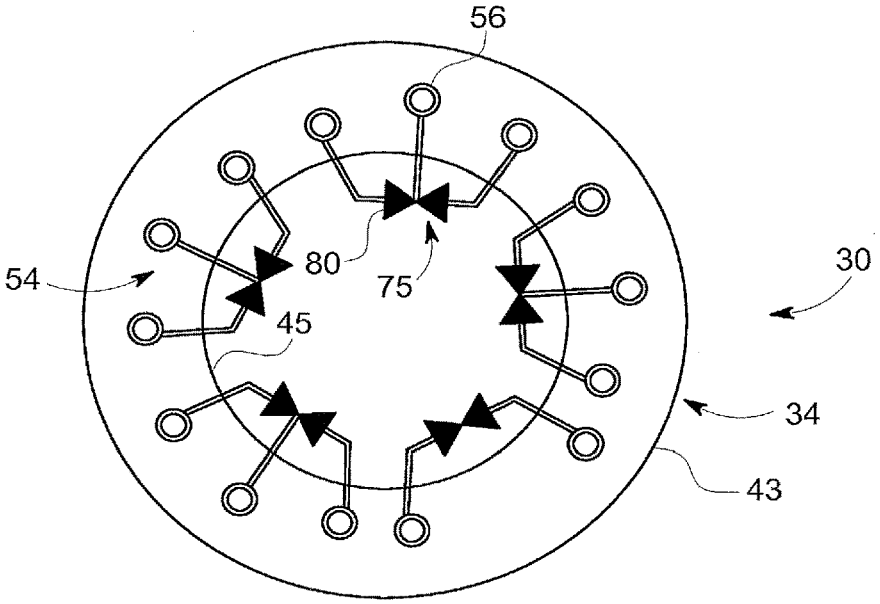
FIG. 6 is a schematic representation of an array of coolant channels of the passive clearance control system, in accordance with yet another aspect of an exemplary embodiment.

In accordance with an aspect of an exemplary embodiment illustrated in FIG. 4, each of the plurality of cooling channels 54 may be provided with a corresponding passive flow modulating device 75. Each passive flow modulating device 75 controls the flow of cooling fluid into a respective one of the plurality of cooling channels 54. Passive flow modulating device 75 may open in response to pressure and/or temperature of fluid in sensing cavity 40. In accordance with an exemplary embodiment illustrated in FIG. 5, a single passive flow modulating device 75 may control cooling flow to all of the plurality of cooling channels 54. In further accordance with an aspect of an exemplary embodiment, each of the plurality of cooling channels 54 may be provided with a secondary passive flow modulating device 84 that controls fluid flow into an associated one of the plurality of cooling channels 54. Secondary passive flow modulating device 84 may take the form of a pressure activated valve which opens in response to a predetermined coolant pressure. Passive flow modulating device 75 may be directly fluidically connected, in series, to each secondary passive flow modulating device 84 or could take the form of a piloted flow valve or actuator that is fluidically isolated from each secondary passive flow modulating device 84 and simply controls a flow of fluid from sensing cavity 40. FIG. 6 illustrates an exemplary aspect in which a plurality of passive flow modulating devices 75 control fluid flow to more than one of the plurality of cooling channels 54. For example, each passive flow modulating device 75 may control cooling fluid delivery to two or more of the plurality of cooling channels 54.

In accordance with an aspect of an exemplary embodiment, turbine section 34 of casing 30 defines a casing volume $V_C$. In further accordance with an exemplary embodiment, plurality of cooling channels 54 collectively defines a channel volume $V_{Ch}$. In accordance with an aspect of an exemplary embodiment, casing volume $V_C$ and channel volume $V_{Ch}$ define a volume ratio of about $0.0002<V_{Ch}/V_C<0.9$. In accordance with another aspect of an exemplary embodiment, casing volume $V_C$ and channel volume $V_{Ch}$ define a volume ratio of about $0.01<V_{Ch}/V_C<0.74$. The volume ratio ensures a desired cooling for casing 30 while also maintaining a desired operational efficiency of turbomachine 4.

Figure 7:
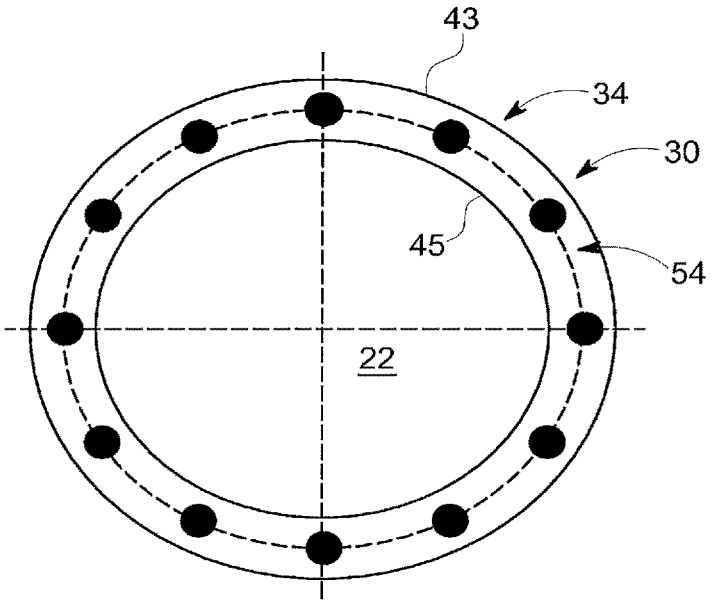
FIG. 7 is a schematic representation of coolant channels having a generally circular cross-section, in accordance with an aspect of an exemplary embodiment.
Figure 8:
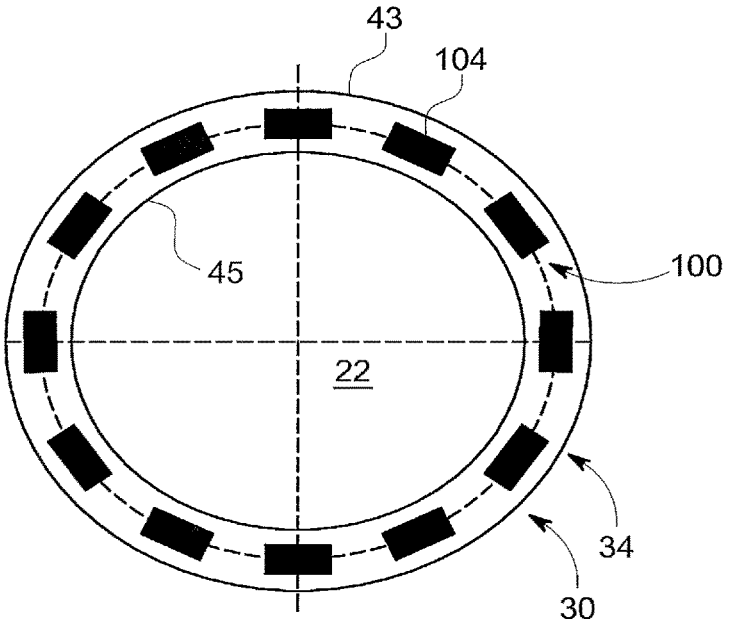
FIG. 8 is a schematic representation of coolant channels having a generally rectangular cross-section, in accordance with an aspect of an exemplary embodiment.
Figure 9:
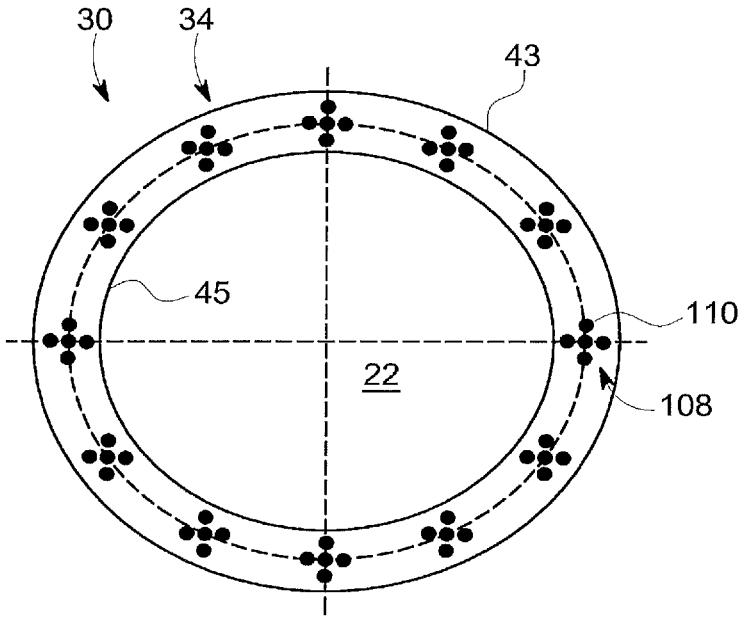
FIG. 9 is a schematic representation of coolant channels arranged in clusters, in accordance with an aspect of an exemplary embodiment.
Figure 10:
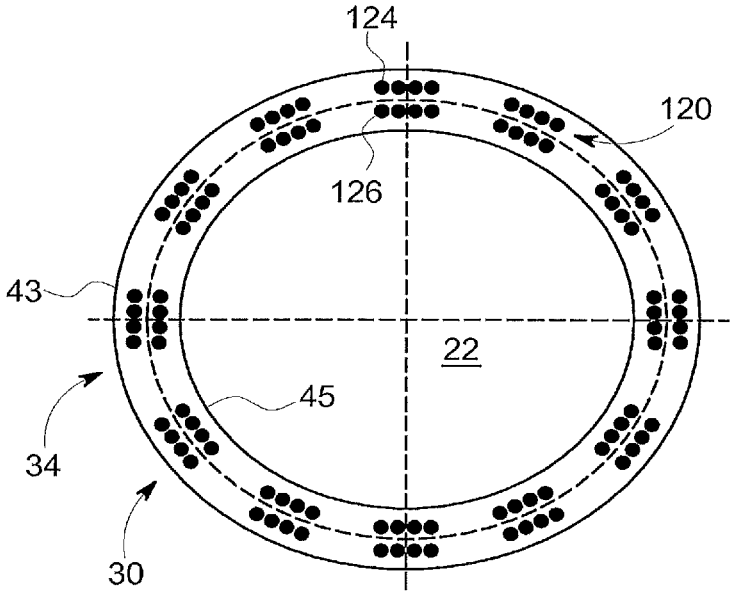
FIG. 10 is a schematic representation of a first plurality of coolant channels and a second plurality of coolant channels arranged radially outwardly of the first plurality of coolant channels, in accordance with an aspect of an exemplary embodiment.

FIG. 7 illustrates plurality of cooling channels 54 arranged in an array about turbine section 34 of casing 30. FIG. 8 illustrates a plurality of cooling channels 100 each having a rectangular cross-section 104. FIG. 9 depicts a plurality of cooling channels 108 arranged in cooling channel clusters 110. FIG. 10 depicts a plurality of cooling channels 120. Cooling channels 120 include first plurality of cooling channels 124 arranged in a first annular array, about and extending through, turbine portion 34 of casing 30, and a second plurality of cooling channels 126 arranged in an annular array radially inwardly of cooling channels 124.

At this point, it should be understood that exemplary embodiments describe a system for passively controlling running clearances in a turbomachine. More specifically, the system employs a valve responsive to a fluid parameter indicative of an operating condition of the turbomachine. In response to detecting a desired operating parameter, the passive flow modulating device selectively controls a flow of cooling fluid through a turbine shell. The cooling fluid passes in a heat exchange relationship with turbine casing. The casing expands and/or contracts resulting from a presence and/or absence of cooling fluid. The expansion and/or contraction of the casing causes a shifting of the turbine shrouds resulting in a change in or adjustment of turbine running clearance.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A turbomachine comprising:

a compressor portion;

a turbine portion operatively connected to the compressor portion, the turbine portion including a turbine casing, a plurality of stators fixedly mounted to the turbine casing, and a plurality of rotating airfoils rotatably supported in the turbine casing;

a combustor assembly including at least one combustor fluidically connecting the compressor portion and the turbine portion, wherein the compressor portion, turbine portion, and combustor assembly are enclosed within a shell of the turbomachine;

a compressor discharge cavity arranged in the compressor portion within the shell of the turbomachine for directing a fluid having a fluid parameter indicative of a desired operational mode of the turbomachine from the compressor portion to the turbine portion; and a passive clearance control system operatively arranged in the turbomachine, the passive clearance control system including at least one passive flow modulating device mounted in the compressor discharge cavity within the shell of the turbomachine responsive to the fluid parameter, and at least one cooling channel extending from the compressor discharge cavity through the turbine casing, the at least one passive flow modulating device selectively passing the fluid from the compressor discharge cavity through the at least one cooling channel to adjust a clearance between the plurality of stators and the plurality of rotating airfoils;

wherein the fluid parameter comprises a temperature or a pressure of the fluid in the compressor discharge cavity the at least one passive flow modulating device comprises at least one first passive flow modulating device and at least one second passive flow modulating device, the at least one first passive flow modulating device including one of a temperature actuated valve and a pressure actuated valve, the at least one second passive flow modulating device including the other one of the temperature actuated valve and the pressure actuated valve.

2. The turbomachine according to claim 1, wherein the at least one cooling channel comprises a plurality of cooling channels and wherein the at least one second passive flow modulating device comprises a plurality of passive flow modulating devices, each of the plurality of passive flow modulating devices being associated with a corresponding one of the plurality of cooling channels.

3. The turbomachine according to claim 1, where the at least one cooling channel comprises a plurality of cooling channels extending through the casing, the at least one passive flow modulating device being fluidically connected to each of the plurality of cooling channels.

4. A turbomachine system comprising:

a compressor portion;

a turbine portion operatively connected to the compressor portion, the turbine portion including a turbine casing, a plurality of stators fixedly mounted to the turbine casing, and a plurality of rotating airfoils rotatably supported in the turbine casing;

an intake system fluidically coupled to the compressor portion, the intake system being operative to condition a flow of intake air to the compressor portion;

an exhaust system fluidically connected to the turbine portion, the exhaust system being operative to condition a flow of exhaust gases passing from the turbine portion;

a load operatively connected to one of the turbine portion and the compressor portion;

a combustor assembly including at least one combustor fluidically connecting the compressor portion and the turbine portion, wherein the compressor portion, turbine portion, and combustor assembly are enclosed within a shell of the turbomachine;

a compressor discharge cavity arranged in the compressor portion within the shell of the turbomachine for directing a fluid having a fluid parameter indicative of a desired operational mode of the turbomachine from the compressor portion to the turbine portion;

a passive clearance control system operatively arranged in the turbomachine system, the passive clearance control system including at least one passive flow modulating device mounted in the compressor discharge cavity within the shell of the turbine and being responsive to the fluid parameter, and at least one cooling channel extending from the compressor discharge cavity through the turbine casing, the at least one passive flow modulating device selectively passing the fluid from the compressor discharge cavity through the at least one cooling channel to adjust a clearance between the plurality of stators and the plurality of rotating airfoils;

wherein the fluid parameter comprises a temperature or a pressure of the fluid in the compressor discharge cavity the at least one passive flow modulating device comprises at least one first passive flow modulating device and at least one second passive flow modulating device, the at least one first passive flow modulating device including one of a temperature actuated valve and a pressure actuated valve, the at least one second passive flow modulating device including the other one of the temperature actuated valve and the pressure actuated valve.

5. The turbomachine system according to claim 4, wherein the at least one cooling channel comprises a plurality of cooling channels and wherein the at least one passive flow modulating device comprises a plurality of passive flow modulating devices, each of the plurality of passive flow modulating devices being associated with a corresponding one of the plurality of cooling channels.

6. The turbomachine system according to claim 4, where the at least one cooling channel comprises a plurality of cooling channels extending through the casing, the at least one passive flow modulating device being fluidically connected to each of the plurality of cooling channels.

7. A method of adjusting rotor blade-to-stator clearance in a turbomachine comprising:

exposing at least one flow modulating device to a fluid parameter of a fluid in an internal sensing cavity of the turbomachine, the fluid parameter indicative of a desired operating mode of the turbomachine, wherein the sensing cavity comprises a compressor discharge cavity disposed within a shell of the turbomachine; and the at least one flow modulating device actuating in response to the fluid parameter at least one passive flow modulating device in response to the fluid parameter; and passing the fluid from the sensing cavity to one or more cooling channels extending through a casing of a turbine portion to passively adjust rotor blade-to-stator clearance in turbine portion;

wherein the fluid parameter comprises a temperature or a pressure of the fluid in the compressor discharge cavity within the shell of the turbomachine, and wherein the at least one passive flow modulating device is mounted in the sensing cavity within the shell of the turbomachine and comprises at least one first passive flow modulating device and at least one second passive flow modulating device, the at least one first passive flow modulating device including one of a temperature actuated valve and a pressure actuated valve, the at least one second passive flow modulating device including the other one of the temperature actuated valve and the pressure actuated valve.

* * * * *